US011425477B2

(12) United States Patent
Fallon

(10) Patent No.: US 11,425,477 B2
(45) **Date of Patent: *Aug. 23, 2022**

(54) RECORDING HIGH OUTPUT POWER LEVELS OF SOUND AT LOW SOUND PRESSURE LEVELS

(71) Applicant: James J. Fallon, Armonk, NY (US)

(72) Inventor: James J. Fallon, Armonk, NY (US)

( * ) Notice: Subject to any disclaimer, the term of this patent is extended or adjusted under 35 U.S.C. 154(b) by 12 days.

This patent is subject to a terminal disclaimer.

(21) Appl. No.: 16/928,109

(22) Filed: Jul. 14, 2020

(65) Prior Publication Data

US 2021/0136472 A1 May 6, 2021

Related U.S. Application Data

(63) Continuation of application No. 15/984,534, filed on May 21, 2018, now Pat. No. 10,750,261, which is a (Continued)

(51) Int. Cl.
*H04R 29/00* (2006.01)
*H04R 1/02* (2006.01)

(Continued)

(52) U.S. Cl.
CPC ..... *H04R 1/025* (2013.01); *H04R 1/222* (2013.01); *H04R 1/2803* (2013.01); *H04R 3/04* (2013.01);

(Continued)

(58) Field of Classification Search
CPC ..... H04R 1/02; H04R 1/025; H04R 29/003

(Continued)

(56) References Cited

U.S. PATENT DOCUMENTS 3,213,181 A 10/1965 Snoddy et al.
4,805,728 A 2/1989 Carter et al.

(Continued)

FOREIGN PATENT DOCUMENTS

GB 2083974 A 3/1982
WO 9307729 A 4/1993

(Continued)

OTHER PUBLICATIONS

Screen capture and transcript from Edwards Vacuum YouTube video entitled "Experiment #6 What happens to sound in a vacuum chamber demonstrated with an alarm", uploaded on Jul. 26, 2016. Retrieved from Internet https://www.youtube.com/watch?v=oY_9hKdTG8o.*

(Continued)

*Primary Examiner* — Katherine A Faley
(74) *Attorney, Agent, or Firm* — Ryan, Mason & Lewis, LLP; Frank V. DeRosa

(57) ABSTRACT

Systems, methods, and apparatus are provided for recording high output power levels of sound at low sound pressure levels. For example, an apparatus comprises an enclosure, a speaker disposed within the enclosure, a microphone disposed within the enclosure, and an evacuation port. The evacuation port is configured to connect to a system that reduces a pressure level within the enclosure to a level that is less than an ambient air pressure level outside the enclosure. The enclosure is sealed or otherwise configured to provide a sealed enclosure, to maintain the reduced air pressure within the enclosure. The speaker can be driven by an amplifier at high output power levels to generate a distorted sound of an amplified electric musical instrument for recording purposes, while the reduced pressure level within the enclosure serves to attenuate the sound pressure (Continued)

level and perceived loudness which emanates from the speaker.

24 Claims, 9 Drawing Sheets

Related U.S. Application Data continuation of application No. 15/671,058, filed on Aug. 7, 2017, now Pat. No. 9,980,023.

(51) Int. Cl.

| | |
|---|---|
| ***H04R 1/28*** | (2006.01) |
| ***H04R 5/02*** | (2006.01) |
| ***H04R 1/22*** | (2006.01) |
| ***H04R 3/04*** | (2006.01) |

(52) U.S. Cl.
CPC ..... *H04R 5/02* (2013.01); *H04R 29/003* (2013.01); *H04R 2420/07* (2013.01); *H04R 2420/09* (2013.01)

(58) Field of Classification Search
USPC ..... 381/59, 345, 386, 396
See application file for complete search history.

(56) References Cited

U.S. PATENT DOCUMENTS

| | | | |
|---|---|---|---|
| 4,914,750 | A | 4/1990 | Lawson |
| 4,957,184 | A | 9/1990 | Negishi |
| 7,783,069 | B1 | 8/2010 | Miller et al. |
| 9,992,592 | B1 | 6/2018 | Alam et al. |
| 2002/0137478 | A1 | 9/2002 | Masamura |
| 2006/0039578 | A1 | 2/2006 | Stiles |
| 2008/0019551 | A1 | 1/2008 | Watanabe |
| 2008/0043435 | A1 | 2/2008 | Yip et al. |
| 2013/0089231 | A1 | 4/2013 | Wilk et al. |
| 2013/0283915 | A1 | 10/2013 | Booth |
| 2016/0286301 | A1 | 9/2016 | Agerkvist et al. |
| 2017/0195790 | A1 | 7/2017 | Choisel et al. |

FOREIGN PATENT DOCUMENTS

| | | | |
|---|---|---|---|
| WO | 2018139995 | A1 | 8/2018 |
| WO | PCT/US18/45663 | | 10/2018 |
| WO | PCT/US19/46002 | | 10/2019 |
| WO | 2016186997 | A1 | 11/2019 |

OTHER PUBLICATIONS

R. G. Keen, "A Musical Distortion Primer," Geo-Fex Cybernetic Music, www.geofex.com/effxfaq/distn101.htm, 1993-2000, 7 pages.
"Chapter 1: Fundamentals of Amplification," unifi-uat.fusionwifi.com/chapter_1_fundamentals_of_amplification.pdf, Jun. 9, 2017, 35 pages.
Amptone.com, "Guitar Amp Tone, Effects Placement, and Cranked-Amp Tone at Any Volume," http://www.amptone.com/, 1997, 22 pages.
Blackstone Appliances.com, "Distortion 101," http://blackstoneappliances.com/dist101.html, 3 pages.
H. F. Olson, "The Measurement of Loudness," Audio, Feb. 1972, pp. 18-22.
Wikipedia.org, "Ideal Gas Law," https://en.wikipedia.org/wiki/Ideal_gas_law, Oct. 6, 2017, 8 pages.
Thermaxx Jackets.com, "Sound Pressure Math Made Easy," https://www.thermaxxjackets.com/sound-pressure-math/, Feb. 26, 2015, 6 pages.
Sengpie/Audio.com, "Levels and References of the Sound Quantities," http://www.sengpielaudio.com/calculator-soundvalues.htm, Jul. 30, 2017, 11 pages.
"Speed of Sound in Air," Physics of Music—Notes, https://pages.mtu.edu/~suits/SpeedofSound.html, 2 pages.
Wikipedia.org, "Sound Pressure," https://en.wikipedia.org/wiki/Sound_pressure, Jun. 30, 2017, 10 pages.
Wikipedia.org, "Isolation Cabinet (Guitar)," https://en.wikipedia.org/wiki/Isolation_cabinet_(guitar), Jul. 23, 2015, 3 pages.
Wikipedia.org, "Sound Energy Density," https://en.wikipedia.org/wiki/Sound_energy_density, Nov. 3, 2016, 2 pages.
M. Florentine, "It's Not Recruitment—Gasp! It's Softness Imperception," Hearing Journal, Mar. 2003, 9 pages, vol. 56, No. 3.
Wikipedia.org, "Loudness," https://en.wikipedia.org/wiki/Loudness, Sep. 26, 2017, 5 pages.
Wikipedia.org, "Loudspeaker," https://en.wikipedia.org/wiki/Loudspeaker, Sep. 13, 2017, 32 pages.
Wikipedia.org, "Power Attenuator (Guitar)," https://en.wikipedia.org/wiki/Power_attenuator_(guitar), Aug. 21, 2017, 2 pages.
EBU—Operating Eurovision and Euroradio, "Loudness Normalisation and Permitted Maximum Level of Audio Signals," EBU R 128-2014, Jun. 2014, 5 pages.
Wikipedia.org, "Sound Pressure," https://en.wikipedia.org/wiki/Sound_pressure, Sep. 15, 2017, 11 pages.
Fuzzeffect.com, "FuzzEffect—The Fuzz Story & Photos," http://www.fuzzeffect.com/, 1 page.
R. Aiken, "What is "Sag"?," Aiken Amplification, Inc., Feb. 19, 2014, 3 pages.
"Loudness and the Perception of Intensity," http://www.phon.ucl.ac.uk/courses/spsci/AUDL4007/Intensity%202014.pdf, 45 pages.

* cited by examiner

400

RECORDING HIGH OUTPUT POWER LEVELS OF SOUND AT LOW SOUND PRESSURE LEVELS

CROSS-REFERENCE TO RELATED APPLICATIONS

This application is a Continuation of U.S. patent application Ser. No. 15/984,534, filed on May 21, 2018, now U.S. Pat. No. 10,750,261, which is a Continuation of U.S. patent application Ser. No. 15/671,058, filed on Aug. 7, 2017, now U.S. Pat. No. 9,980,023, the disclosures of which are fully incorporated herein by reference.

TECHNICAL FIELD

The field relates generally to audio recording techniques.

BACKGROUND

Since the early 1950s, musicians have utilized various distortion techniques to alter the sound of amplified electric musical instruments, such as electric guitars, to produce distorted sounds that are typically desired for use in recording many types of music genres including pop, blues, and rock music genres. In general, such distortion techniques include, for example, overdriving preamplifiers and/or power amplifiers, creating power supply sag, causing output transformer saturation, overdriving speakers, utilizing specially designed "distortion effect" pedal devices. There are limitations to each type of distortion technique, and often the more desirous power amplifier, output transformer, and speaker distortion techniques require operating an amplifier at or near its maximum output power level for driving speakers, which results in correspondingly high sound pressure levels emanating from the speakers.

With the advent of low-cost high resolution non-linear multi-track recording systems, low cost preamplifiers, inexpensive microphones and monitor systems, along with virtual instruments and effects processors, home recording has reached near epidemic levels. The ability to record music at home has created a revolution in music production. However, the use of overdriving amplifiers to achieve the desired distorted sound of amplified electric musical instruments, such as guitars, can be problematic in home environments and many other places due to the significantly high sound pressure levels that are output from the speakers, which can be disruptive and audibly annoying to nearby individuals and neighbors.

In both commercial and home recording spaces, the high sound pressure levels utilized for amplified instrument recording causes significant complexity and cost in designing and building recording studios. Various instruments and players are often recorded simultaneously on separate recording tracks and require significant if not near perfect acoustic isolation. For example, if a singer and a guitar player are recording simultaneously, then the guitar amplifier will need to be physically and acoustically isolated from the singer and the microphone. The high sound pressure level from the guitar amplifier often acoustically bleeds into the singer's microphone, making it difficult or often not possible to process the singer's voice. Thus, typical mixing effects utilized in real-time or during post recording editing and mixing (such as pitch correction with Autotune® or Melodyne®), along with the myriad of other modern effects utilized in production, will not function properly as the vocal track is essentially contaminated by the sound of the guitar amplifier. In addition, high sound pressure levels can damage certain types of microphones prohibiting their use and/or limit the placement of certain types of microphones for recording.

SUMMARY

Embodiments of the invention generally include apparatus, systems, and methods for generating sound by amplifiers and speakers at high output power levels, while recording the generated sound at low sound pressure levels.

In one embodiment of the invention, an apparatus comprises an enclosure, a speaker disposed within the enclosure, a microphone disposed within the enclosure, and an evacuation port. The evacuation port is configured to connect to a system that reduces a pressure level within the enclosure to a level that is less than an ambient air pressure level outside the enclosure. The enclosure is sealed or otherwise configured to provide a sealed enclosure, to maintain the reduced air pressure within the enclosure. The speaker can be driven by an amplifier at high output power levels to generate a distorted sound of an amplified electric musical instrument for recording purposes, while the reduced pressure level within the enclosure serves to attenuate the sound pressure level and perceived loudness which emanates from the speaker.

Another embodiment includes a method for recording music. The method comprises feeding an output signal of a musical device into a sound system, and recording an output of the sound system. The sound system comprises a sealed enclosure, a speaker and a microphone disposed within the sealed enclosure, wherein the speaker generates sound in response to the output signal of the musical device, and wherein the microphone generates an acoustic signal in response to the sound generated by the speaker. Recording the output of the sound system comprises recording the acoustic signal generated by the microphone in response to the sound generated by the speaker within the sealed enclosure while an air pressure level within the sealed enclosure is maintained at a level that is less than ambient air pressure level outside the sealed enclosure.

Other embodiments of the invention will be described in the following detailed description of embodiments, which is to be read in conjunction with the accompanying figures.

DETAILED DESCRIPTION

Figure 1:
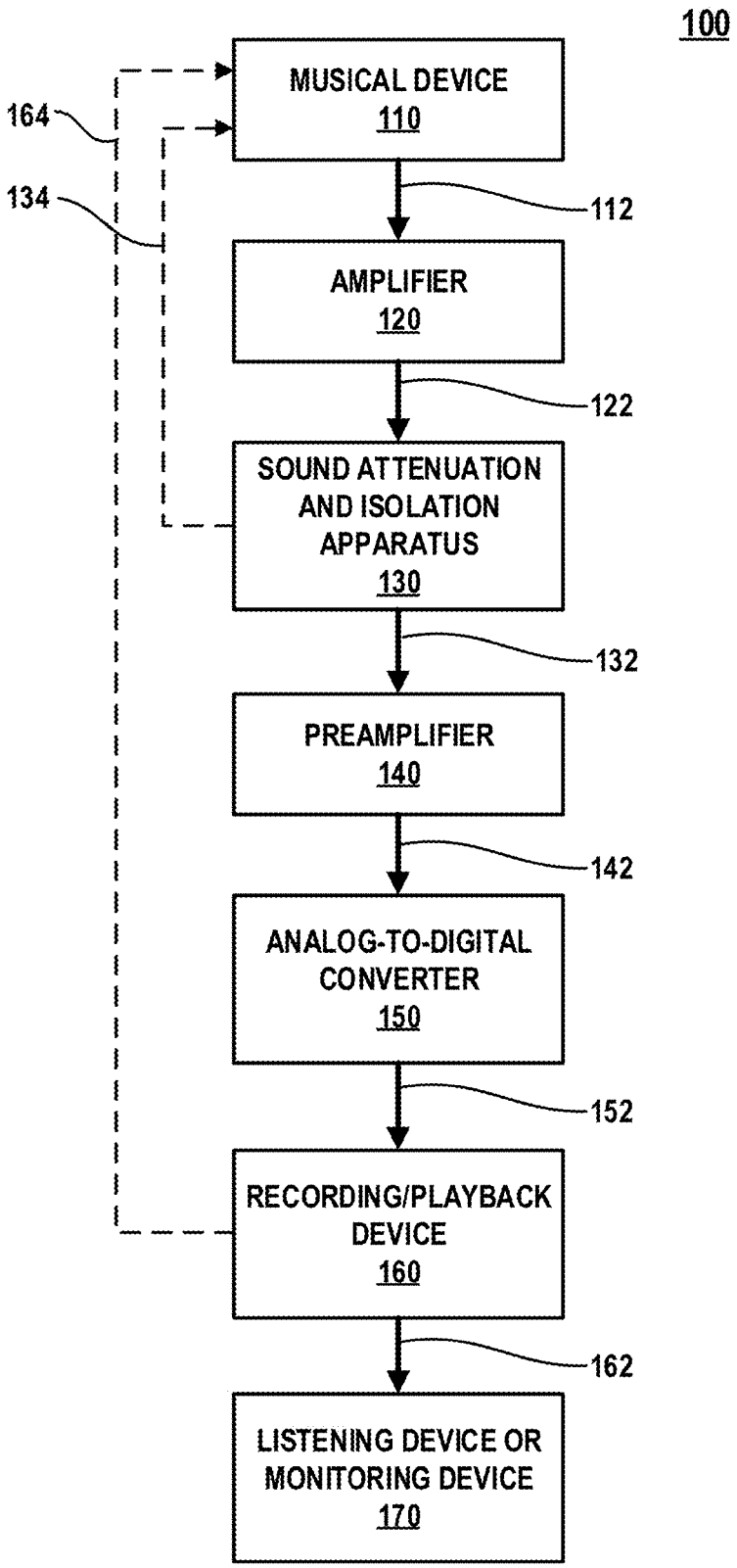
FIG. 1 illustrates a block diagram of a system for recording high output power levels of sound at low loudness levels using a sound attenuation and isolation apparatus, according to an embodiment of the invention.

Embodiments of the invention will now be described in further detail with regard to systems, methods, and apparatus for recording high output power levels of sound at low sound pressure levels. It is to be understood that the same or similar reference numbers are used throughout the drawings to denote the same or similar features, elements, or structures, and thus, a detailed explanation of the same or similar features, elements, or structures will not be repeated for each of the drawings. It is to be further understood that the term "about" as used herein with regard to thicknesses, widths, lengths, etc., is meant to denote being close or approximate to, but not exactly.

As explained in further detail below, embodiments of the invention include different configurations of sound attenuation and isolation apparatus. In general, a sound attenuation and isolation apparatus according to an embodiment of the invention comprises an enclosure, at least one speaker disposed within the enclosure, at least one microphone disposed within the enclosure, and an evacuation port disposed within a wall of the enclosure. The evacuation port is configured to connect to a system that can evacuate air or any other gas from within the enclosure to reduce a pressure level within the enclosure to a level that is less than an ambient air pressure level outside the enclosure. The enclosure is sealed or otherwise configured to provide a sealed enclosure, to maintain the reduced air/gas pressure within the enclosure. The speaker can be driven at high output power levels from an amplifier to generate a distorted sound of an amplified electric musical instrument for recording purposes, while the reduced pressure level within the enclosure serves to attenuate the sound pressure level and perceived loudness which emanates from the speaker.

It should be noted that the sealed enclosure may have an acceptable leak rate such that the reduced pressure level within the enclosure is maintained for an acceptable period of time for recording use in between evacuations of the enclosure. The evacuations may be conducted at any time prior to, during, or after use including one time, periodically, or on an as-needed basis to reduce the pressure level within the enclosure to the desired level. In particular, the evacuations to reduce the pressure level in the enclosure may be performed one time or periodic, intermittent, semi-continuous, or continuous basis, depending on factors such as (i) the leak rate of the enclosure (if any), (ii) the desired reduced pressure level from ambient in the enclosure, (iii) the rate of evacuation from the evacuation device, and (iv) the method of evacuation.

In this regard, a sound attenuation and isolation apparatus according to an embodiment of the invention serves as an "isolation cabinet" which provides a sound-proof or semi-sound proof enclosure that surrounds the speaker and sound-capturing microphone and prevents sound leakage from within the enclosure to the outside environment. In addition, the decreased pressure within the enclosure (e.g., reduced pressure in a range from below 1 atmosphere to near-vacuum pressure level) serves to attenuate the sound pressure level and perceived loudness which emanates from the speaker within the enclosure, which provides a substantial reduction in sound leakage from within the enclosure to the outside environment. The sound attenuation and isolation apparatus provides a unique solution for overdriving an amplifier to high output power levels for operating the speaker within the enclosure to achieve the distorted sound of amplified electric musical instruments for recording purposes, while reducing the perceived loudness of sound which is generated by the speaker. In other words, the lower the pressure within the enclosure, the lower the sound pressure level produced for an equivalent excursion of the speaker.

Sound level is typically defined in terms of sound pressure level (SPL). SPL is a logarithmic measure of the effective sound pressure of a sound relative to a reference value. It is measured in decibels (dB) above a standard reference level. The standard reference sound pressure in air or other gases is 20 μPa, which is usually considered the threshold of human hearing (at 1 kHz). Sound pressure (φ is a local pressure deviation from the ambient (average, or equilibrium) atmospheric pressure, caused by a sound wave. In air, sound pressure can be measured using a microphone. The SI unit for sound pressure (φ is the pascal (symbol: Pa), which equates to 1 Newton per Meter squared (1 $N/m^2$).

Propagating sound waves in air or a gas induce localized deviations called dynamic pressure in the ambient air or gas referred to as static pressure. If we define the total pressure as ρtotal, the static pressure as ρstatic, and the sound pressure as ρ, then we have the following relationship:

$$\rho_{total}=\rho_{static}+\rho \qquad \text{EQ[1]}$$

If we define Lρ as SPL, the logarithmic measure of the effective pressure of sound relative to a reference value, $\rho_0$ as our reference sound pressure which we will set as 20 μPa (ANSI S1.1-1994 reference level), and ρ as the root mean square sound pressure, Nρ as 1 neper, B as 1 bel which equates to (½ ln 10)Nρ, and 1 dB which equates to (1/20 ln 10) Nρ, then:

$$L\rho = \ln\left(\frac{\rho}{\rho 0}\right)N\rho = 2\log_{10}\left(\frac{\rho}{\rho 0}\right)B = 20\log_{10}\left(\frac{\rho}{\rho 0}\right)\text{dB} \qquad \text{EQ[2]}$$

A sound attenuation and isolation apparatus with reduced pressure within the enclosure allows for standard guitar speakers to operate from guitar amplifiers that provide maximum rated speaker power and yet, at a constant amplifier maximum output level, produce sound pressures from below the threshold of human hearing (with the commonly used reference sound pressure in air is 20 μPa) up through and beyond the maximum rated SPL output of the speaker, which for a typical guitar speaker might be just under 120 dB SPL at a 10 foot listening distance. With a lower limit of audibility defined as SPL of 0 dB, and the upper limit in 1 atmosphere of pressure (approximately $1.01325\times10^5$ Pa) or 194 dB SPL (the largest pressure variation an undistorted sound wave can have in Earth's atmosphere), larger sound waves can be produced within the enclosure, but at lower sound pressure levels and thus lower perceived loudness. Perceived loudness is based upon psychoacoustic phenomenon and is a measure of how a sound is sensed. Factors affecting perceived loudness include sound pressure level, frequency range and associated amplitudes, and the duration and time envelope or function of the sound.

SPL is also often governed by an inverse-proportional law. SPL is measured from the origin of an acoustic event or source, and the sound pressure from a spherical sound wave decreases proportionally to the reciprocal of the distance. The human ear has an extremely large dynamic range. In standard atmospheric pressure, a leaf rustling as ambient sound may create a sound pressure of approximately $6.32\times10^{-5}$ Pa which equates to an SPL of approximately 10 dB. Typical human conversation at a distance of 1 meter ranges from about $2\times10^{-3}$ Pa to about $2\times10^{-2}$ Pa, which equates to an SPL of about 40 dB to about 60 dB. A passenger car as heard from roadside at a distance of 10 meters ranges from approximately about $2\times10^{-2}$ to about $20\times10^{-2}$ Pa which equates to approximately 60 dB to 80 dB. Traffic on a busy roadway at 10 meters is about 0.2 Pa to about 0.632 Pa, which is approximately 80 dB to 90 dB of SPL. An example of a higher SPL is an operating jack hammer at 1 meter, which is approximately 2 Pa or approximately 100 dB SPL. The sound pressure generated by a jet engine at a distance of 100 meters can range from 6.32 Pa to 200 Pa which is approximately equivalent to 110 dB to 140 dB SPL. Moving closer to a jet engine, e.g., 1 meter, increases the sound pressure to a level of about 632 Pa or approximately 150 dB SPL. The threshold of pain for humans is about 63.2 Pa to 200 Pa or about 130 dB to 140 dB. Examples of even higher sound pressure levels include those generated by a 0.30-06 rifle, at a distance of 1 meter, which is approximately 7,265 Pa which or 171 dB SPL. Finally, the theoretical limit for undistorted sound is approximately 101,325 Pa or approximately 194 dB.

FIG. 1 illustrates a block diagram of a system 100 for recording high output power levels of sound at low loudness levels, according to an embodiment of the invention. The system 100 comprises a musical device 110, an amplifier 120, a sound attenuation and isolation apparatus 130, a preamplifier 140, an analog-to-digital converter (ADC) 150, a recording/playback device 160, and a device 170 for listening or monitoring recorded sound. The musical device 110 may comprise any type of musical instrument (e.g., electric guitar) which comprises a pickup or transducer that converts acoustical energy into electrical energy. In another embodiment, the musical device 110 may be a virtual electronic instrument. An electrical output of the musical device 110 is connected to an input of the amplifier 120, typically using a suitable cable and connector 112 such as, for example, a ¼ inch to ¼ inch Monster® guitar cable that is either plugged into or otherwise electrically connected to the input of the amplifier 120 (e.g., Marshall JCM800 50-watt amplifier). The amplifier 120 may comprise any type of amplifier device such as a solid-state amplifier, a tube amplifier, a combination solid-state and tube amplifier, etc.

The sound attenuation and isolation apparatus 130 comprises an enclosure, a speaker disposed within the enclosure, one or more microphones disposed within the enclosure, and an evacuation port. The evacuation port is configured to connect to a system that reduces a pressure level within the enclosure to a level that is less than an ambient air pressure level outside the enclosure. The enclosure is sealed or otherwise configured to be sealed (i.e., sealable) to maintain the reduced pressure level within the enclosure for purposes of recording high output power levels of sound/audio (e.g., generated an output from the amplifier 120) at low sound pressure levels. Various examples of alternative embodiments of the sound attenuation and isolation apparatus 130 will be discussed in further detail below with reference to FIGS. 2 through 6

The amplifier 120 comprises a speaker output port that is electrically connected to a speaker (which is disposed within the sound attenuation and isolation apparatus 130) using a speaker cable 122 (e.g., a ¼ inch to ¼ inch speaker cable or equivalent electrical connection) connected to a speaker input port. The outputs of the one or more microphones (which are disposed within the sound attenuation and isolation apparatus 130) are input to one or more corresponding preamplifier channels of the preamplifier 140 using a microphone cable 132 (e.g., commercially available XLR microphone cables, or equivalents thereof such as a wireless signal connection).

The preamplifier 140 supplies a line level output 142 (or equivalent thereof) to the input of the ADC 150. The ADC 150 digitizes the output signals of the preamplifier 140, and the digital signals are then output as digital codes through one or more digital interfaces 152 to the recording/playback device 160 (or mixing device) wherein the digital signals are recorded. An analog or digital output signal 162 from the recording/playback device 160 is input to the listening/monitoring device 170 (e.g., a powered or unpowered monitoring device or headset). If the device 170 is an unpowered monitoring device, a power amplifier would be utilized to drive the device 170. If the output 162 of the recording/playback device 160 is a digital signal, a digital-to-analog converter (DAC) would be used to convert the digital signal to an analog signal for input to the listening/monitoring device 170.

While the connections 112, 132, 142, 152 and 162 may be implemented as hard-wired connections using suitable cables and connectors, in alternate embodiments, the connections 112, 132, 142, 152 and 162 may be implemented wirelessly using any suitable wireless technology with sufficient bandwidth. The wireless network architecture may be implemented using a serial or star network topology, or using any suitable network topology that provides sufficient bandwidth for real-time connectivity with an acceptable latency for recording or playback purposes.

Furthermore, in an alternate embodiment, feedback signals 134 and 164 may be supplied to the musical device 110 from the sound attenuation and isolation apparatus 130 and the recording/playback device 160, respectively, to assist in generating feedback from the amplified signal. In particular, the feedback signal 134 may be an acoustic or electric signal (analog or digital) that is input to a transducer mounted on or near the musical device 110 to generate the feedback. A digital feedback signal would be converted to analog feedback signal using a DAC device. Similarly, the feedback signal 164 (analog or digital) from the recording/playback device 160 would be input to a transducer mounted on or near the musical device 110 to assist in generating feedback.

It should be noted that while various components of the system 100 are shown in FIG. 1 as discrete elements with wired or wireless interconnects, some components may be integrated within a common housing with alternative interconnection topologies. For example, with miniaturization, it may be possible to house the amplifier 120, the sound attenuation and isolation apparatus 130, the preamplifier 140, and the recording/playback device 160 in a highly-miniaturized enclosure. Integrated circuits, miniaturized speakers, discrete microphone elements, and recording/playback devices can be utilized to make the various components of the sound attenuation and isolation apparatus 130 fit within a relatively small enclosure. While there may be various tradeoffs with useful frequency range and power consumption, however, with very hard vacuums and high efficiency speakers, extremely low power consumption may be utilized to simulate very high sound pressure levels.

Figure 2:
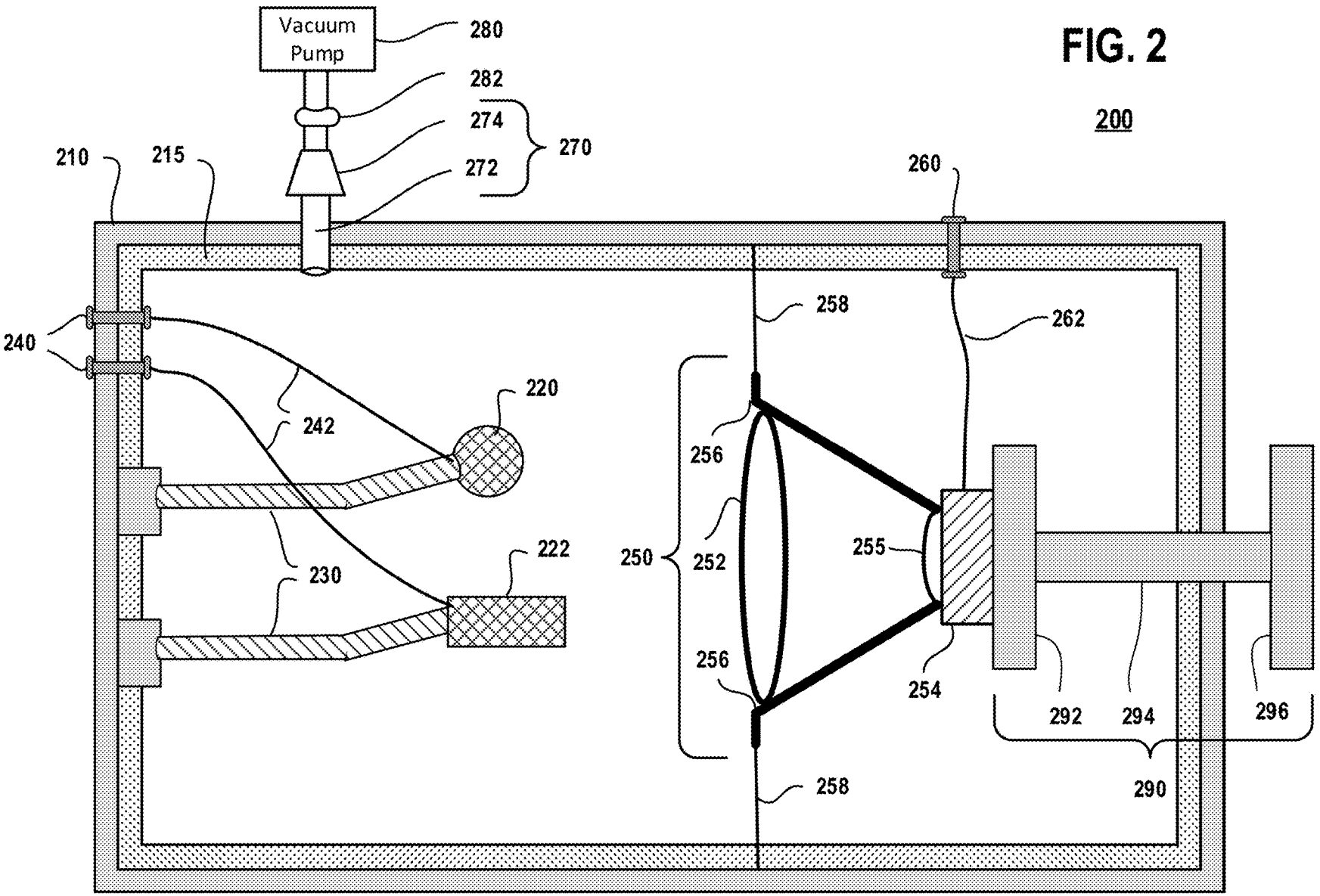
FIG. 2 schematically illustrates a sound attenuation and isolation apparatus according to an embodiment of the invention.

FIG. 2 schematically illustrates a sound attenuation and isolation apparatus 200 according to an embodiment of the invention. The sound attenuation and isolation apparatus 200 illustrates an embodiment of the attenuation and isolation apparatus 130 which can be implemented in the system of FIG. 1. The sound attenuation and isolation apparatus 200 comprises a sealed enclosure 210 with an optional layer of sound absorbing material 215 disposed adjacent to inner walls of the enclosure 210. The layer of sound absorbing material 215 may line substantially an entire inner surface of the enclosure 210, or the layer of sound absorbing material 215 may be disposed in strategic regions on the inner walls of the enclosure 210 to provide sound isolation and/or reduce internal acoustic wave reflections. Preferably the sound absorbing material comprises a material that is non-outgassing at reduced pressure levels within the enclosure 210. Ideally, the enclosure 210 can be anechoic, however the amount of sound reflections within the enclosure 210 is less problematic when the air/gas pressure within the enclosure 210 is reduced.

A plurality of microphones 220 and 222 are disposed within the enclosure 210. The microphones 220 and 222 are mounted to an inner wall of the enclosure 210 using microphone mounts 230 such as gooseneck microphone mounts, or other types of commercially available shock and vibration isolation mounts for microphones which eliminate or reduce vibrational coupling to the enclosure 210. In addition, position adjustable microphone placement allows for optimal microphone placement for recording. Since sound pressure levels within the enclosure 210 (which emanate from a speaker 250 disposed within the enclosure 210) are significantly reduced using techniques discussed herein, vibration by mechanical modes of the microphone mounts 230 and the enclosure 210 are less significant. While the example embodiment of FIG. 2 shows the use of two microphones 220 and 220 within the enclosure, it is to be noted that a single microphone may be disposed within the enclosure 210 for purposes of capturing the sound output from the speaker 250. However, the use of multiple microphones is often desirous to take advantage of optimal microphone placement and microphone characteristics. For example, in modern studio recordings of amplified guitar, it is often common practice to utilize a dynamic microphone such as a Sure® SM57 and a ribbon microphone such as Royer® R122.

The enclosure 210 comprises microphone feedthrough connectors 240 which are internally connected to the microphones 220 and 222 using microphone cables 242. In one embodiment, the microphone feedthrough connectors 240 comprise XLR male to female feedthrough adapters, or any other commercially available feedthrough adapter that is suitable for the given application. The microphones 220 and 222 may comprise one or more of various types of microphones including dynamic microphones (which utilizes a wire coil, magnet, and a thin diaphragm to capture an acoustic signal), condenser microphones (which capture an acoustic signal using a variable capacitance to provide enhanced frequency and transient responses) and/or ribbon microphones (which use a thin electrically conductive ribbon placed between poles of a magnet to produce a voltage by electromagnetic induction). The condenser and certain types of active ribbon type microphones use phantom power to operate, i.e DC electric power transmitted through microphone cables to operate the microphones. It should be noted that phantom power may be supplied to one or more of the microphones 220 and/or 222 using XRL connectors which are configured to connect to the microphone feedthroughs 240 and supply phantom power to the microphones 220 and 222 via the microphone cables 242, if needed.

Further, the speaker 250 disposed within the enclosure 210 comprises a speaker cone 252 (or diaphragm), a speaker coil/magnet assembly 254, a dust cover 255 to cover the speaker coil, and a speaker frame 256 (or basket). The speaker 250 may be any commercially available speaker (e.g., guitar speaker) which is suitable for the given application. The speaker 250 is mounted inside the enclosure 210 using a mounting device 258 that is connected to the speaker frame 256. The speaker mounting device 258 may comprises any suitable mounting device such as a taught wire, a spring mechanism, or other type of mounting mechanism, preferably one that minimizes or eliminates vibrational coupling between the speaker 250 and the enclosure 210. In addition, the speaker mounting device 258 should provide for unrestricted air flow within the enclosure 210 and, in particular, between the front and the back of the speaker 250.

The enclosure 210 further comprises a speaker feedthrough connector 260 which is internally connected to the speaker 250 using a speaker cable 262 to provide audio signals and electrical power to the speaker 250 from an amplifier (e.g., amplifier 120, FIG. 1). Preferably the speaker feedthrough connector 260 allows for the passage of electrical current at voltages and power levels that are sufficient to operate the speaker 250 to maximum levels and beyond with a minimal loss of energy. In one embodiment, the speaker feedthrough connector 260 is configured to connect to an external ¼" female jack, as is standard with most guitar amplifier interconnects.

The sound attenuation and isolation apparatus 200 further comprises an evacuation port 270 which comprises a feedthrough port 272 and a valve 274. The evacuation port 270 is configured to connect to a vacuum pump 280 (or some other similar device or system) via a suitable connector 282. The vacuum pump 280 operates to evacuate air from within the enclosure 210 to reduce a pressure level within the enclosure 210 to a target pressure level which less than an ambient air pressure level outside the enclosure 210. The enclosure 210 provides a sealed environment to maintain the reduced pressure level within the enclosure 210. The valve 274 of the evacuation port 270 allows for sealing the feedthrough port 272 to maintain the reduced pressure levels within the enclosure 210 without the continuous use of the evacuation pump 280 or other evacuation device. The vacuum pump 280 can be an electric or manual pump, and can be active either manually or automatically during speaker sound production so that any sound emanating from the vacuum pump 280 does not interfere with the microphones 220 and 222 capturing the sound (of the musical device to be recorded) emanating from the speaker 250. It should be noted that due to a reduced air pressure level within the enclosure 210, any external sounds will also have negligible or no effect on the sound that is captured by the microphones 220 and 222.

An optional vacuum gauge or pressure monitoring device can be utilized to determine the air/gas pressure within the enclosure 210, which will allow user to reduce the pressure within the enclosure 210 to a target level which optimizes the use of the sound attenuation and isolation apparatus 200 for recording sound at lower sound pressure levels. In an alternate embodiment, the pressure within the enclosure 210 can be decreased to an even lower pressure level than is desired for the given application, and then the enclosure 210 can be backfilled with a dry inert gas, such as dry nitrogen gas, while keeping the pressure inside the enclosure 210 lower than 1 atmosphere to reduce the SPL generated by the speaker. Dry nitrogen has the advantage of being non-condensing which is important if the temperature within the enclosure 210 significantly decreases, and is inert on the internal transducers and component materials within the enclosure 210. In another embodiment, the sealed enclosure 210 can be backfilled with dry nitrogen at pressures greater than 1 atmosphere. With pressures that are higher than 1 atmosphere, it is possible to create sound pressure levels which are greater than the sound pressure levels that can be created in 1 atmosphere, allowing sound to be generated at even greater sound levels.

In another embodiment, a cooling device 290 may be thermally coupled to the speaker coil/magnet assembly 254 of the speaker 250 to prevent excessive thermal build-up of the speaker 250 and the coil/magnet assembly 254. It is known that overheating of a speaker coil is a predominant mode of speaker failure. In addition, it is generally known that speaker efficiencies range from about 0.5% to about 20% with typical efficiencies of 4% to 10% for certain applications. For example, for a 40-watt speaker at 5% efficiency, 38 watts of electrical energy is dissipated as heat, while only 2 watts is converted into acoustical energy. A speaker has a thermal resistance between the speaker coil and magnet structure, which is in parallel with a thermal capacitance of the voice coil, and in series with a thermal resistance of the speaker magnet to the ambient air. While sufficient heat may be dissipated from the speaker coil/magnet assembly 254 to surrounding air at under 1 atmosphere, the ability to dissipate heat to the surrounding air within the enclosure 210 of the sound attenuation and isolation apparatus 200 becomes more problematic as the air/gas pressure (air and/or nitrogen) within the enclosure 210 is evacuated to pressures lower than 1 atmosphere, as there is less thermal transfer of heat from the speaker coil/magnet assembly 254 to the surrounding air/gas within the enclosure 210.

In this regard, in one embodiment of the invention, the cooling device 290 may comprise a passive heat sink device that conducts thermal energy away from the speaker coil/magnet assembly 254 to the ambient environment external to the enclosure 210. In particular, as shown in FIG. 2, the cooling device 290 comprises a first portion 292, a second portion 294, and a third portion 296. The first portion 292 is thermally coupled to the backside of the speaker coil/magnet assembly 254 to absorb heat therefrom. The second portion 294 extends through a wall of the enclosure 210 to transfer heat from the first portion 292 to the third portion 296 outside the enclosure 210, wherein the transferred heat is dissipated from the third portion 296 to the ambient environment external to the enclosure 210 through radiative heat transfer. When implemented as a passive heat sink device, the cooling device 290 is formed of a material such as copper or aluminum which has a thermal conductivity sufficient for the given application. The cooling device 290 is implemented using a sufficient seal for the second portion 294 extending through the wall of the enclosure 210 so that the enclosure 210 can maintain a reduced pressure when air is evacuated from within the sealed enclosure 210, while providing the means to radiate or transfer heat from the speaker coil/magnet assembly 254 to the ambient environment external to the enclosure 210. In another embodiment, the cooling device 290 can be an active cooling device such as a Joule-Thomson cooler, an active liquid cooling system, a thermal electric cooler, a fan, or any combination thereof. Furthermore, the enclosure 210 may be constructed of a material with high thermal conductivity and/or coated with a high emissivity surface to radiate heat from within the enclosure 210 to the external environment. In yet another embodiment the cooling device 290 is coupled to a closed loop temperature controller to maintain an optimal or desired speaker operating temperature.

It should be noted that the reduced sound pressure levels presented to the internal microphones 220 and 222 for recording have several additional advantages. For example, many high-quality microphones, and in particular especially ribbon microphones, are not compatible with high sound pressure levels, limiting their use or proximity placement to a speaker that generates the sound to be recorded. Ribbon microphones are easily damaged by high sound pressure levels. For example, a Coles® 4038 Ribbon microphone can accommodate a maximum sound pressure of 125 dB. A 50-watt amplifier and standard efficiency speaker in ambient atmosphere can easily generate 140 dB SPL within a few inches of the speaker, which is often a typically desired microphone placement. Thus, embodiments of sound attenuation and isolation apparatus as discussed herein enables sound recording with a wider variety of desirous microphones and microphone placements.

In another embodiment, an optional warning indicator device may be coupled to the optional pressure gauge to warn of sound pressure levels being generated within the enclosure 210 which exceed a given sound pressure level that may damage one of more of the different types of microphones 220 and/or 222 of the sound attenuation and isolation apparatus. In addition, the optional pressure gauge may be operatively coupled to an inhibit device or disconnect device, which prevents power from being applied to the speaker 250 while the internal pressure is detected to be above a specified threshold. Alternately, the optional pressure gauge may be operatively coupled to an enable device or connect device which enables power to be applied to the speaker 250 from the amplifier 120 while the internal pressure is at or below a specified threshold.

In another embodiment, the enclosure 210 may be formed of a rigid material or flexible material. For example, the enclosure 210 may be formed of one or more of Polyester (PES), Polyethylene terephthalate (PET), Polyethylene (PE), High-density polyethylene (HDPE), Polyvinyl chloride (PVC), Polyvinylidene chloride (PVDC), Low-density polyethylene (LDPE), Polypropylene (PP), Polystyrene, (PS), High-impact polystyrene (HIPS), Polyamides (PA), Acrylonitrile butadiene styrene (ABS), Polycarbonate (PC), Polycarbonate/Acrylonitrile Butadiene Styrene (PC/ABS), Polyurethane (PU), Maleimide/bismaleimide, Melamine formaldehyde (MF), Plastarch material, Phenolics (PF) or (phenol formaldehydes), Polyepoxide (epoxy), Polyetheretherketone (PEEK), Polyimide, Polylactic acid (PLA), Polymethyl methacrylate (PMMA) (acrylic), Polytetrafluoroethylene (PTFE), Urea-formaldehyde (UF), Furan, Silicone, and Polysulfone.

Figure 3:
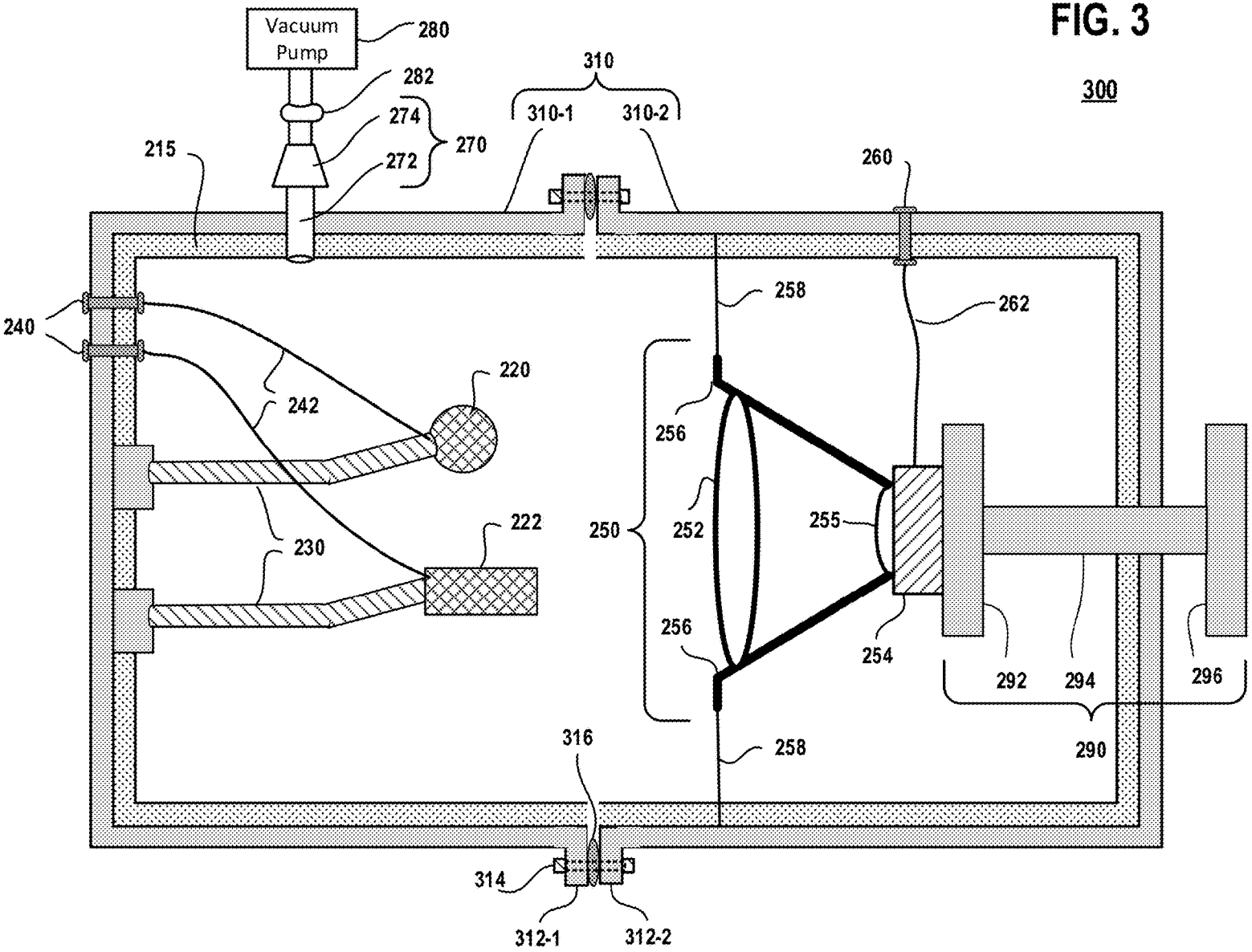
FIG. 3 schematically illustrates a sound attenuation and isolation apparatus according to another embodiment of the invention.

FIG. 3 schematically illustrates a sound attenuation and isolation apparatus 300 according to another embodiment of the invention. The sound attenuation and isolation apparatus 300 illustrates an embodiment of the sound attenuation and isolation apparatus 130 which can be implemented in the system of FIG. 1. The sound attenuation and isolation apparatus 300 is similar to the sound attenuation and isolation apparatus 200 of FIG. 2 as discussed above, except that the sound attenuation and isolation apparatus 300 shown in FIG. 3 comprises a multi-piece enclosure 310. For example, the enclosure 310 comprises a two-piece enclosure assembly comprising a first portion 310-1 and a second portion 310-2.

The enclosure 310 allows access to the internal components such as the speaker 250, microphones 220 and 220, microphone mounts 230, cables 242 and 262, and other components, while the enclosure portions 310-1 and 310-2 can be assembled to together to form a sealed enclosure 310.

In particular, as shown in FIG. 3, each portion 310-1 and 310-2 of the enclosure 310 comprises a respective mating flange 312-1 and 312-2 formed around a perimeter opening thereof, which can be joined together using a fastener 314 (e.g., threaded bolts and nuts, clasps, etc.) with a sealing member 316 (rubber O-ring, gasket, etc.) disposed between the mating flanges 312-1 and 312-2 to provide a sealed enclosure 310 when the two portions 310-1 and 310-2 are assembled together. The enclosure 310 can be formed of any suitable material such as a metallic material, a high impact plastic material, or a rubberized material preferably having low cold flow and outgassing properties, or other enclosure materials as discussed herein. In another embodiment, one or more hinges may be utilized to retain the two portions 310-1 and 310-2 of the enclosure 310 together and facilitate alignment of the two portions 310-1 and 310-2.

Moreover, one or more manually adjustable clasp devices may be utilized to squeeze the mating flanges 312-1 and 312-2 together with the sealing member 316 disposed between the mating flanges 312-1 and 312-2 to provide the sealed enclosure 310. It is to be appreciated that as the enclosure 310 is evacuated, the atmospheric pressure external to the enclosure 310 will exert an additional force to push the enclosure portions 310-1 and 310-2 together, thereby exerting additional sealing force on the enclosure 310. Optionally, a transparent window or view port may be formed in a region of one or both of the enclosure portions 310-1 and 310-2 to allow a user to view the internal components (e.g., speaker operation) when then enclosure 310 is assembled. In addition, either a portion, or one half, of the entire enclosure 310 may be transparent.

In addition to, or in lieu of, a two-part enclosure, the enclosure may have an access door which can be completely removed or joined by a hinge and mated to the enclosure using a fastener (e.g., threaded bolts and nuts, clasps, etc.) with a sealing member (rubber O-ring, gasket, etc.) disposed between the surface of the door and the enclosure to provide a sealed enclosure. One or more manually adjustable clasp devices may be utilized to squeeze the door to the enclosure. The door may be opaque or transparent.

Figure 4:
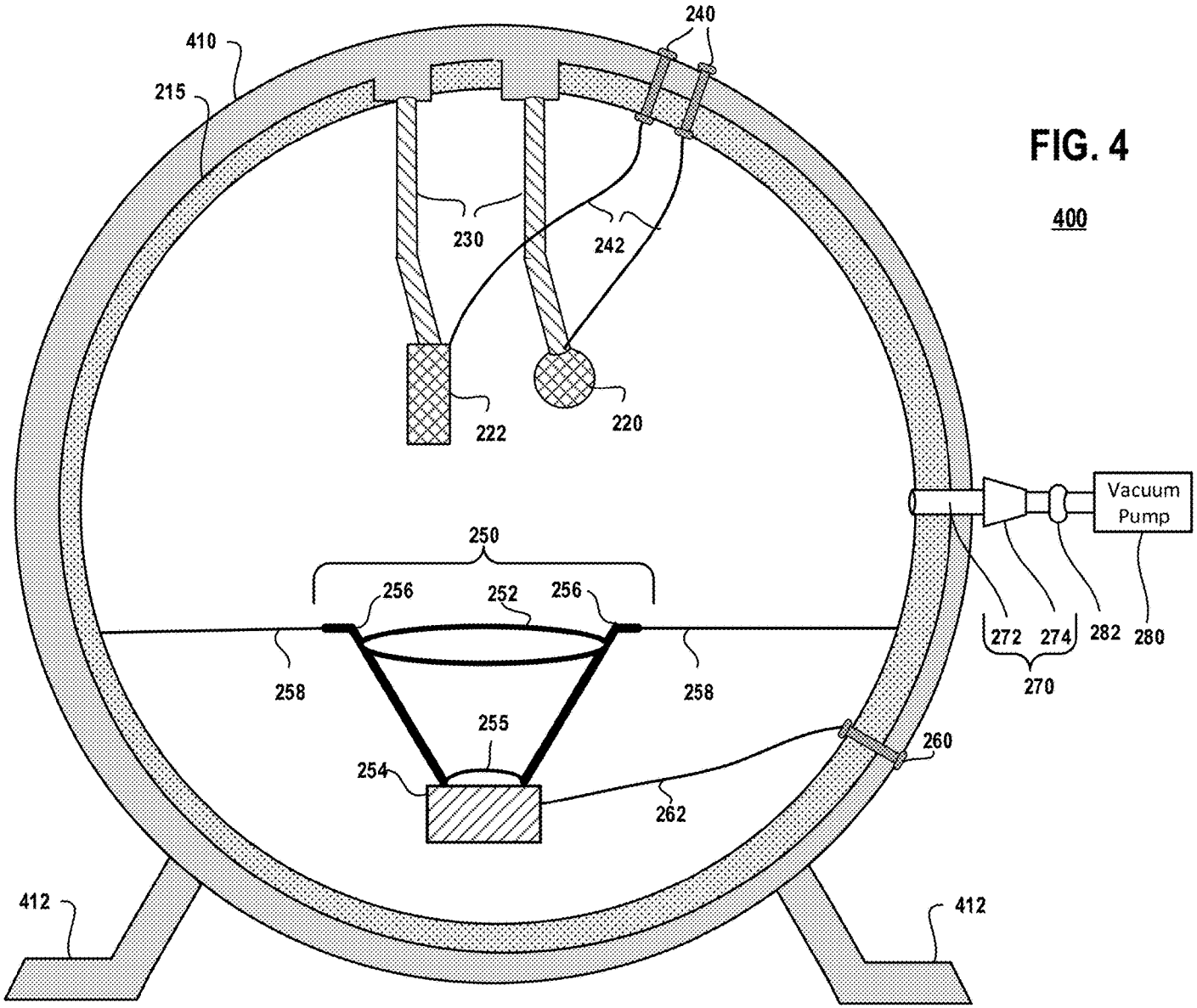
FIG. 4 schematically illustrates a sound attenuation and isolation apparatus according to another embodiment of the invention.

FIG. 4 schematically illustrates a sound attenuation and isolation apparatus 400 according to another embodiment of the invention. The sound attenuation and isolation apparatus 400 illustrates an embodiment of the sound attenuation and isolation apparatus 130 which can be implemented in the system of FIG. 1. The sound attenuation and isolation apparatus 400 is similar to the embodiments of the sound attenuation and isolation apparatus discussed above, except that the sound attenuation and isolation apparatus 400 shown in FIG. 4 comprises spherical-shaped enclosure 410 which is designed to minimize standing waves that typically occur with square or rectangular shapes, or enclosures of any shape which utilize edges. The spherical-shaped enclosure 410 comprises a plurality of stabilizing feet 412 (e.g., tripod arrangement) so that the spherical-shaped enclosure 410 can be placed on a flat surface. It should be noted that the enclosure 410 can be designed with other shapes having smooth curved surfaces with radii of curvature that are sufficiently large, which are sufficient to minimize standing waves within the enclosure. While not shown in FIG. 4, a cooling device 290 (such as shown in FIGS. 2 and 3) can be thermally coupled to the speaker coil/magnet assembly 254 to transfer heat from the speaker coil/magnet assembly 254 to the ambient environment external to the enclosure 410. In another embodiment, the enclosure 410 may be a sealable enclosure which comprises two or more portions that can be assembled together in manner analogous to the enclosure 310 of FIG. 3.

Figure 5:
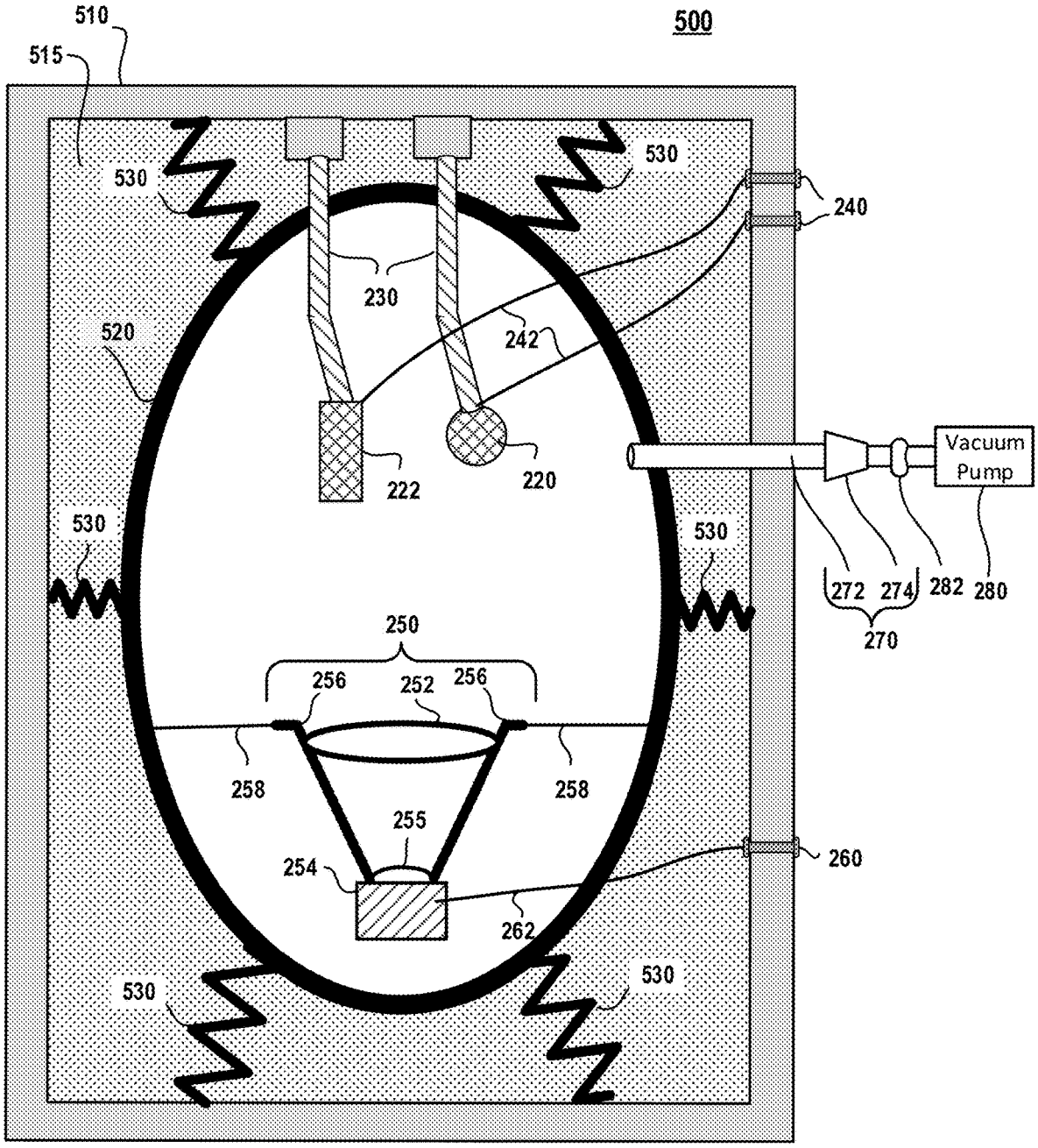
FIG. 5 schematically illustrates a sound attenuation and isolation apparatus according to another embodiment of the invention.

FIG. 5 schematically illustrates a sound attenuation and isolation apparatus 500 according to another embodiment of the invention. The sound attenuation and isolation apparatus 500 illustrates an embodiment of the sound attenuation and isolation apparatus 130 which can be implemented in the system of FIG. 1. The sound attenuation and isolation apparatus 500 comprises an enclosure comprising an outer enclosure 510 and an inner enclosure 520 with optional acoustic absorbing material 515 disposed in the space between the outer and inner enclosures 510 and 520. As shown in FIG. 5, the inner enclosure 520 is formed with curved surfaces to minimize standing wavers and wave reflections. The inner enclosure 520 comprises a bladder structure which is formed with a stiff or flexible rubber material (or other types of suitable material), and which is designed to not collapse under pressures of approximately 1/10th of an atmosphere or less. In another embodiment, the inner enclosure 520 can be formed of a sound absorbing material, e.g. rubber. The inner enclosure 520 is connected to the outer enclosure 510 through one or more isolation mounts 530, wherein the isolation mounts 530 may comprise springs, spring like material, or inflatable cushions such as bubble wrap. The inner enclosure 520 can be constructed in using one or more separate pieces, with gaskets or other methods of sealing the pieces together. While not shown in FIG. 5, a cooling device 290 (such as shown in FIGS. 2 and 3) can be thermally coupled to the speaker coil/magnet assembly 254 to transfer heat from the speaker coil/magnet assembly 254 to the ambient environment external to the enclosure 510.

Figure 6:
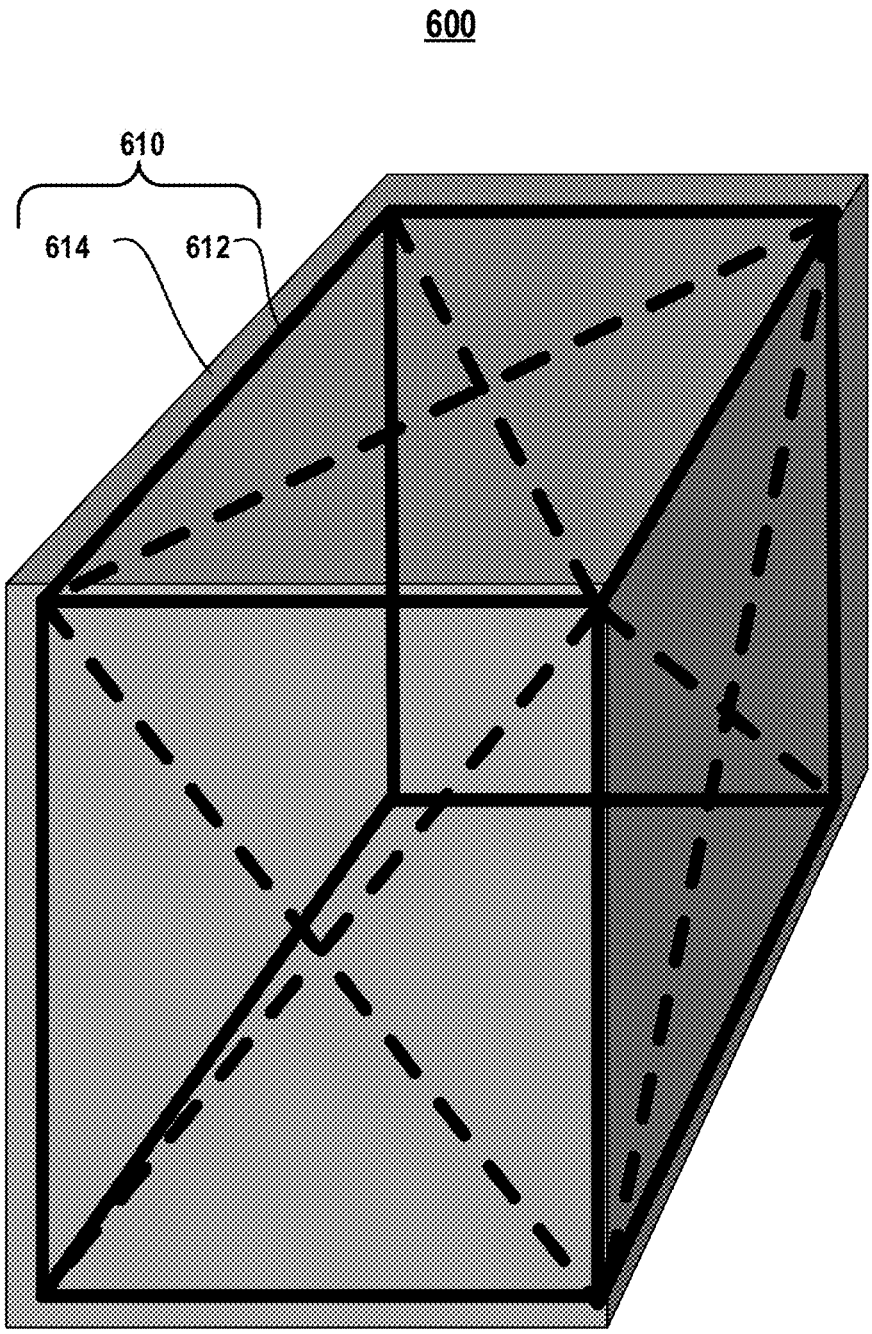
FIG. 6 schematically illustrates a sound attenuation and isolation apparatus according to another embodiment of the invention.

FIG. 6 schematically illustrates a sound attenuation and isolation apparatus 600 according to another embodiment of the invention. The sound attenuation and isolation apparatus 600 illustrates an embodiment of the sound attenuation and isolation apparatus 130 which can be implemented in the system of FIG. 1. The sound attenuation and isolation apparatus 600 is similar to the embodiments of the sound attenuation and isolation apparatus discussed above (with regard to components such as speakers, microphones, cables, vacuum evacuation port, etc.), except that the sound attenuation and isolation apparatus 600 shown in FIG. 6 comprises an enclosure 610 which comprises a supporting frame 612 encapsulated within a bag 614. While the supporting frame 612 is generically and schematically shown in FIG. 6 for illustrative purposes, it is to be understood that the supporting frame would be properly configured to provide means for fixedly mounting the internal components (microphone stands, feedthroughs speakers, evacuation port, etc.) within the enclosure 610. The outer bag 614 could be implemented using any commercially available plastic bags, or custom designed bags, with sufficient thickness and strength (e.g., 10 mil and above) to withstand damage from external pressure when the interior is evacuated.

When operating a speaker at high power levels in a sound attenuation and isolation apparatus with a lower internal air pressure, the speaker cone (or diaphragm) may be damaged over time from being over extended due the lack of sufficient air pressure within the sealed enclosure to provide an opposing force to the movement of the speaker cone. In addition, speaker characteristics may change from operation in a standard 1 atmosphere operating environment. In this regard, various techniques can be implemented according to embodiments of the invention for mechanically damping the speaker cone to compensate for the difference in movement (resonance) of the speaker cone when operating in normal atmosphere pressure as compared to movement of the speaker cone when operating in a low atmospheric pressure to a near vacuum environment.

Figure 7:
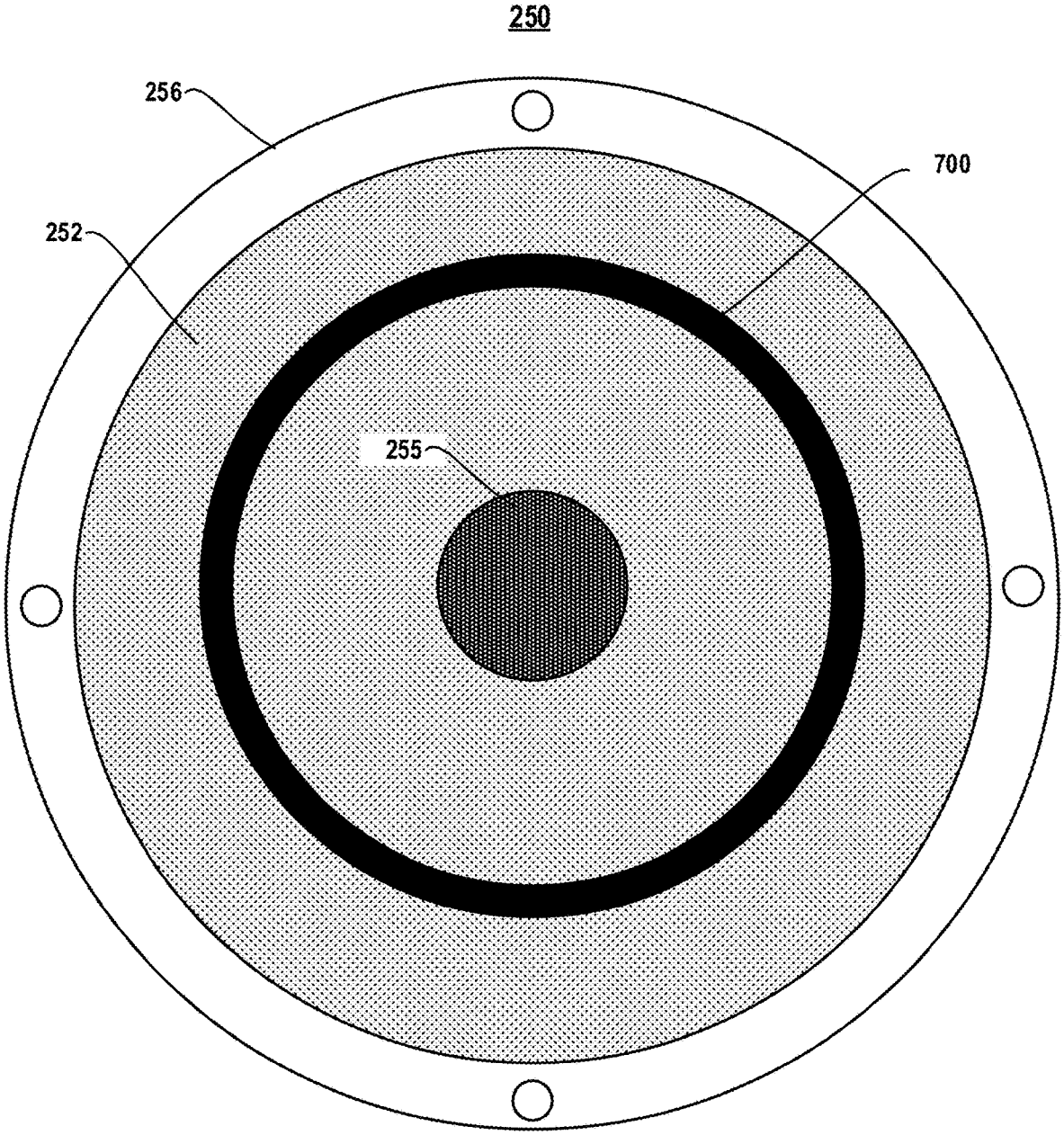
FIG. 7 schematically illustrates a method for mechanically damping the motion of a speaker cone according to an embodiment of the invention.

For example, FIG. 7 schematically illustrates a method for mechanically damping the motion of a speaker cone according to an embodiment of the invention. FIG. 7 is a schematic front view of the speaker 250 shown throughout the drawings, in which a mechanical damper weight 700 is glued or other affixed to the speaker cone 252 to assist in mechanical damping of the speaker and to help compensate for the difference of in-atmosphere to in-near vacuum or lower pressure resonance. The mechanical damper weight 700 can be formed of any suitable material, size, mass, etc., which is sufficient to achieve the intended results for the target application.

Figure 8:
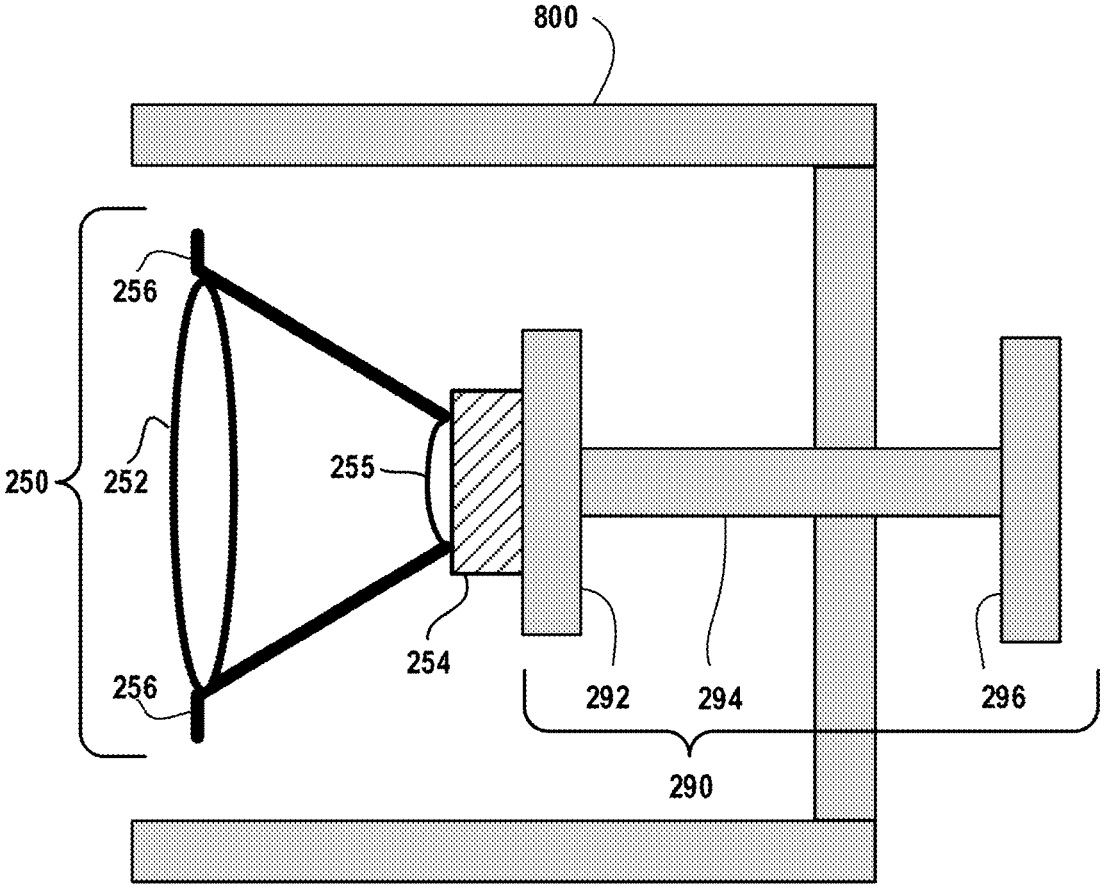
FIG. 8 schematically illustrates a method for mechanically damping the motion of a speaker cone according to another embodiment of the invention.

FIG. 8 schematically illustrates a method for mechanically damping the motion of a speaker cone according to another embodiment of the invention. In particular, FIG. 8 schematically illustrates a mechanical damping system which comprises a cooling system configured to cool the speaker cone 252 (which results in stiffening of the speaker cone 252) through the use of conductive cooling using the cooling device 290 as discussed above, in addition to a radiative cooling device 800 which surrounds the sides and back of the speaker 250. The radiative cooling device 800 is formed of a thermal conductive material (e.g., copper, aluminum, etc.) which serves to absorb heat from the speaker 250 and assist in stiffening the speaker cone 252 by cooling, thereby resulting in mechanical damping of the speaker cone 254. The cooling devices 290 and 800 can be implemented using passive or active cooling systems, or a combination thereof.

Figure 9:
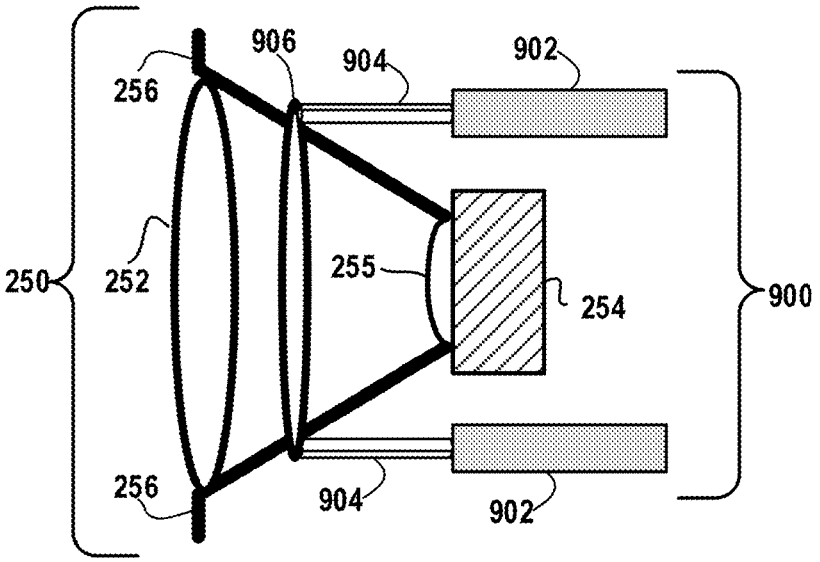
FIG. 9 schematically illustrates a method for mechanically damping the motion of a speaker cone according to another embodiment of the invention.

FIG. 9 schematically illustrates a method for mechanically damping the motion of a speaker cone according to another embodiment of the invention. In particular, FIG. 9 schematically illustrates a mechanical damping system which comprises a viscous damping system 900 mechanically coupled to the speaker cone 252 to mechanically damp the motion of the speaker cone 252. The viscous damping system 900 (e.g., hydraulic damping system) comprises a plurality of cylinders 902 with pistons 904 that extend in and out of the cylinder 902 under manual or automated control settings. The pistons 904 are coupled to an attachment ring 906 which is affixed around an outer surface of the speaker cone 252 to assist in mechanical damping of the speaker cone 252 and to help compensate for the difference of in-atmosphere pressure to in-near vacuum or lower pressure resonance. The amount of resistive force that the attachment ring 906 applies to the speaker cone 252 can be adjustably varied by automated or manual control of the viscous damping system 900, depending on air pressure level within sealed enclosure.

It should be noted that embodiments of the invention for reducing sound pressure levels as discussed herein can be utilized in conjunction with other types of existing solutions to further reduce sound pressure levels. By way of example, such sound reducing solutions include baffling at various angles to reduce wave reflections, other sound suppression techniques used in isolation cabinets, and sound suppression systems and devices such as isolation boxes, power attenuators, flux density attenuation speakers, and fluxtone technology.

Although illustrative embodiments of the present invention have been described herein with reference to the accompanying figures, it is to be understood that the invention is not limited to those precise embodiments, and that various other changes and modifications may be made therein by one skilled in the art without departing from the scope of the appended claims.

What is claimed is:

1. An apparatus, comprising:

an enclosure comprising a reduced pressure level within the enclosure, which is at least 10% less than an ambient air pressure level outside the enclosure, wherein the enclosure is sealed to maintain the reduced pressure level within the enclosure;

a speaker disposed within the enclosure, wherein the speaker is configured to output a sound signal in response to an input signal, wherein the sound signal is directed into the enclosure, and wherein the reduced pressure level within the enclosure is configured to reduce a perceived loudness of the sound signal output from the speaker;

a microphone disposed within the enclosure, wherein the microphone is configured to capture the sound signal output from the speaker; and a cooling device thermally coupled to the speaker and configured to absorb heat generated by the speaker and thereby cool the speaker, wherein a portion of the cooling device extends through a sealed aperture of the enclosure and is disposed outside the enclosure to thereby transfer heat from the speaker to an ambient environment outside the enclosure.

2. The apparatus of claim 1, wherein the enclosure comprises a speaker input port that is configured to provide a wired connection to an input of the speaker.

3. The apparatus of claim 2, wherein the speaker input port is configured for connection to a musical instrument or a musical device to provide the input signal to the speaker.

4. The apparatus of claim 2, wherein the speaker input port is configured for connection to an amplifier to provide the input signal to the speaker.

5. The apparatus of claim 1, further comprising a wireless system which is configured to provide a wireless connection to an input of the speaker.

6. The apparatus of claim 1, further comprising a wireless system which is configured to provide a wireless connection to an output of the microphone.

7. The apparatus of claim 1, wherein the enclosure comprises an evacuation port.

8. The system of claim 1, wherein the enclosure comprises a pressure gauge or a pressure monitoring device.

9. The apparatus of claim 1, wherein the cooling device comprises a passive heat sink device.

10. The apparatus of claim 1, wherein the cooling device comprises an active cooling device.

11. The apparatus of claim 10, wherein the active cooling device comprises at least one of a Joule-Thomson cooling device, an active liquid cooling system, and a thermal electric cooling device.

12. The apparatus of claim 10, wherein the active cooling device is further configured to cool the speaker to a sufficient temperature which results in stiffening a speaker cone of the speaker to thereby mechanically damp the speaker cone during operation of the speaker.

13. A system, comprising:

an apparatus comprising:

an enclosure comprising a reduced pressure level within the enclosure, which is at least 10% less than an ambient air pressure level outside the enclosure, wherein the enclosure is sealed to maintain the reduced pressure level within the enclosure;

a speaker disposed within the enclosure, wherein the speaker is configured to output a sound signal in response to an input signal, wherein the sound signal is directed into the enclosure, and wherein the reduced pressure level within the enclosure is configured to reduce a perceived loudness of the sound signal output from the speaker;

a microphone disposed within the enclosure, wherein the microphone is configured to capture the sound signal output from the speaker; and a feedback system configured to provide a feedback signal to a source of the input signal to thereby generate feedback from the input signal.

14. The system of claim 13, further comprising a musical instrument or a musical device, which is configured to generate the input signal that is applied to the speaker.

15. The system of claim 13, further comprising an amplifier which is configured to generate the input signal that is applied to the speaker.

16. The system of claim 15, further comprising a musical instrument or a musical device, which is connected to the amplifier, wherein the input signal is generated by the amplifier in response to a signal emanating from the musical instrument or the musical device.

17. The system of claim 13, wherein the feedback system is configured to provide the feedback signal from an output of the apparatus.

18. The system of claim 13, wherein the feedback system is configured to provide the feedback signal from a playback device or a recording device, which is coupled to an output of the apparatus.

19. The system of claim 13, wherein the feedback signal comprises an acoustic signal.

20. The system of claim 13, wherein the feedback signal comprises an electrical feedback signal.

21. The system of claim 20, wherein the electrical feedback signal comprises an analog signal.

22. The system of claim 20, wherein the electrical feedback signal comprises a digital signal.

23. The system of claim 20, further comprising a transducer which is configured to receive the electrical feedback signal.

24. The system of claim 23, wherein the transducer comprises a speaker which is external to the apparatus, wherein the external speaker is disposed in sufficient proximity to a musical instrument to induce a desired level of feedback or a type of feedback.

* * * * *